US010242564B2

(12) United States Patent
Shin et al.

(10) Patent No.: US 10,242,564 B2
(45) Date of Patent: Mar. 26, 2019

(54) INTEGRATED REMOTE CONTROL SYSTEM AND COMPUTER READABLE RECORDING MEDIUM FOR STORING REMOTE CONTROLLING METHOD

(71) Applicants: HYUNDAI MOTOR COMPANY, Seoul (KR); KIA MOTORS CORPORATION, Seoul (KR)

(72) Inventors: Hyoung Shin, Gyeonggi-do (KR); Hui Sung Lee, Gyeonggi-do (KR); Youngwook Song, Seoul (KR); Kichang Yi, Gyeonggi-do (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 15/650,201

(22) Filed: Jul. 14, 2017

(65) Prior Publication Data

US 2018/0165948 A1 Jun. 14, 2018

(30) Foreign Application Priority Data

Dec. 13, 2016 (KR) ..... 10-2016-0169859

(51) Int. Cl.
*G08C 17/02* (2006.01)
*G08C 23/04* (2006.01)

(52) U.S. Cl.
CPC ..... *G08C 17/02* (2013.01); *G08C 23/04* (2013.01); *G08C 2201/70* (2013.01); *G08C 2201/92* (2013.01)

(58) Field of Classification Search
None
See application file for complete search history.

(56) References Cited

U.S. PATENT DOCUMENTS 7,705,746 B2 * 4/2010 Pittard ..... G08C 17/02 340/12.24
8,558,716 B2 * 10/2013 Roberts ..... G08C 17/02 340/12.22
8,654,074 B1 * 2/2014 Auguste ..... G06F 1/1632 345/156
8,935,440 B2 * 1/2015 Davis ..... G06F 13/10 701/29.1
9,171,410 B2 * 10/2015 Yamada ..... G06F 21/34
9,196,155 B2 * 11/2015 Katsuyama ..... G08C 23/04
9,437,102 B2 * 9/2016 Arling ..... G08C 19/28
(Continued)

FOREIGN PATENT DOCUMENTS

KR 10-1583831 B1 1/2016
KR 10-1601109 B1 3/2016

*Primary Examiner* — Fekadeselassie Girma
(74) *Attorney, Agent, or Firm* — Morgan Lewis & Bockius LLP

(57) ABSTRACT

An integrated remote control system includes a user operation device for receiving a control object list and a control item list from a function device physically coupled thereto, and for outputting the received control object list and the received control item list for a user to select therefrom one or more of a control object and a control item, and a gateway connected to the user operation device through a wireless communication network, the gateway generating and outputting a control signal corresponding to one or more of the control object and the control item selected by the user.

8 Claims, 5 Drawing Sheets

(56) References Cited

U.S. PATENT DOCUMENTS 9,587,958 B2 * 3/2017 Campbell ..... B60R 11/0252
9,729,929 B2 * 8/2017 Leary ..... H04N 21/482
9,813,759 B2 * 11/2017 Klein ..... H04M 1/72533
2002/0167696 A1 * 11/2002 Edwards ..... G08C 23/04 398/106
2009/0172129 A1 * 7/2009 Singh ..... G06F 17/3089 709/217
2011/0312278 A1 * 12/2011 Matsushita ..... H04L 12/40013 455/66.1
2013/0332979 A1 * 12/2013 Baskaran ..... H04N 21/42207 725/132
2014/0196067 A1 * 7/2014 Shaposhnik ..... H04N 21/42202 725/14
2014/0266639 A1 * 9/2014 Zises ..... G08C 17/02 340/12.28
2014/0277805 A1 * 9/2014 Browne, Jr. ..... H05B 37/0272 700/295
2015/0003811 A1 * 1/2015 Kandekar ..... G06F 17/30029 386/261
2015/0185964 A1 * 7/2015 Stout ..... G06F 3/0481 715/716
2015/0189059 A1 * 7/2015 Shen ..... H04W 12/04 455/559
2015/0237251 A1 * 8/2015 Yang ..... H04N 5/23203 348/211.2
2015/0282073 A1 * 10/2015 Davidson ..... H04W 52/0209 455/41.2
2015/0365432 A1 * 12/2015 O'Dowd ..... H04L 63/1466 726/22
2016/0044359 A1 * 2/2016 Leary ..... H04N 21/482 725/59
2016/0073172 A1 * 3/2016 Sharples ..... H04N 21/4126 725/53
2017/0048368 A1 * 2/2017 Kohnke ..... H04M 1/6091
2017/0085389 A1 * 3/2017 Yun ..... H04W 76/10
2017/0347233 A1 * 11/2017 Glatfelter ..... H04W 4/023
2018/0014172 A1 * 1/2018 Baldree ..... H04W 4/90

* cited by examiner

INTEGRATED REMOTE CONTROL SYSTEM AND COMPUTER READABLE RECORDING MEDIUM FOR STORING REMOTE CONTROLLING METHOD

CROSS-REFERENCE TO RELATED APPLICATION

This application claims the benefit of priority to Korean Patent Application No. 10-2016-0169859, filed with the Korean Intellectual Property Office on Dec. 13, 2016, the entire contents of which are incorporated herein by reference.

TECHNICAL FIELD

The present disclosure relates to an integrated remote control system and a computer readable recording medium storing a remote control method using the same.

BACKGROUND

A remote control is a device which controls a remotely positioned electronic device through a wireless communication, and a user uses a plurality of remote controls according to types and brands of electronic devices that the user operates. The remote control increases the ease of use because a user can control various functions of electronic devices at a remote location from the device. However, the remote control may have difficulties in a case that the user has a plurality of electronic devices because the user searches all the remote controls to find out the remote control corresponding to a control object.

Accordingly, the use of an integrated remote control increases utility in controlling a plurality of electronic devices using one remote control. However, it is difficult to integrate a plurality of remote controls made by different manufacturers and having different functions in one remote control.

Korean patent No. 10-1601109 (hereinafter, "prior art 1") discloses an integrated remote controller that is directed to an electronic device that is a control object among a plurality of electronic devices and controls the electronic device of the control object. Korean patent No. 10-1583831 (hereinafter, "prior art 2") discloses an integrated remote control that selects a convenience device that is a control object among a plurality of convenience devices using angular speed of a MEMS (Micro-Electro-Mechanical System) gyroscope.

According to prior art 1 and the prior art 2, only a predetermined control object can be controlled based on a pre-stored control program but it is difficult to control a newly-added control object. In order to control a newly-added control object, a control program corresponding thereto should be newly installed. Therefore, such a system is cumbersome to use.

The above information disclosed in this Background section is only for enhancement of understanding of the background of the disclosure and therefore it may contain information that does not form the prior art that is already known in this country to a person of ordinary skill in the art.

SUMMARY

The present disclosure has been made in an effort to provide an integrated remote control system and a computer readable recording medium storing a remote control method using the same having advantages of inputting a control object and a control item through a user operation device and generating and outputting a control signal corresponding to the control object and the control item through a gateway.

In addition to the object, an exemplary embodiment of the present disclosure may be used to accomplish other objects which are not mentioned specifically.

An integrated remote control system according to an exemplary embodiment of the present disclosure may include: a user operation device receiving a control object list and a control item list from a function device physically coupled thereto, and outputting the received control object list and the received control item list so as for a user to select a control object and/or a control item; and a gateway connected to the user operation device through a wireless communication network and generating and outputting a control signal corresponding to the control object and/or the control item selected by the user.

The user operation device may include: a first outputting portion outputting the control object list and the control item list received from the function device; a control object information transmitting portion transmitting control object information about the control object selected by the user to the gateway; and a control item information transmitting portion transmitting control item information about the control item selected by the user.

The user operation device may include a plurality of button keys corresponding to the control item list, and a button key corresponding to the control item list of the control object selected by the user among the plurality of button keys may be highlighted.

The gateway may include: a control information storing portion storing a control item and a control code of the control object corresponding to the function device; a control object information receiving portion receiving the control object information selected by the user; a control signal generating portion receiving the control item information selected by the user and generating a control signal including the received control item information based on the stored control code; and a control signal outputting portion outputting the generated control signal.

The control object information receiving portion may transmit a response signal to the user operation device when the control item and the control code corresponding to the received control object information exist in the control information storing portion. The user operation device may output the control item list corresponding to the control object information when the user operation device receives the response signal.

The integrated remote control system may further include: a control information requesting portion requesting the control item and the control code to a server when the control item and the control code corresponding to the control object information do not exist in the control information storing portion.

A computer readable recording medium according to another exemplary embodiment of the present disclosure may record program instructions for executing a remote control method through an integrated remote control system. The computer readable recording medium may include: program instructions for storing a control item and a control code of a control object corresponding to a function device coupled to a user operation device in a control information storing portion; program instructions for receiving the control object information transmitted from the user operation device through a control object information receiving portion and transmitting a response signal to the user operation device; program instructions for receiving a control item information from the user operation device through a control item information receiving portion in response to the response signal; program instructions for generating a control signal including the received control item information based on the control code through a control signal generating portion; and program instructions for outputting the generated control signal through a control signal outputting portion.

The computer readable recording medium may further include: program instructions for searching the control item corresponding to the received control object information among the control items stored in the control information storing portion and outputting the searched control item in a voice message type.

The computer readable recording medium may further include: program instructions for requesting the control item and the control code to a server through a control information requesting portion when the control item and the control code corresponding to the received control object information is not searched from the control items and the control codes stored in the control information storing portion.

Some aspects of the present disclosure provide an integrated remote control system, comprising a user operation device for receiving a control object list and a control item list from a function device physically coupled thereto, and for outputting the received control object list and the received control item list for a user to select therefrom one or more of a control object and a control item; and a gateway connected to the user operation device through a wireless communication network, the gateway generating and outputting a control signal corresponding to one or more of the control object and the control item selected by the user.

Some aspects of the present disclosure provide a computer readable recording medium which records program instructions for executing a remote control method through an integrated remote control system, the computer readable recording medium comprising program instructions for storing a control item and a control code of a control object corresponding to a function device coupled to a user operation device in a control information storing portion; program instructions for receiving the control object information transmitted from the user operation device through a control object information receiving portion and transmitting a response signal to the user operation device; program instructions for receiving a control item information from the user operation device through a control item information receiving portion in response to the response signal; program instructions for generating a control signal including the received control item information based on the control code through a control signal generating portion; and program instructions for outputting the generated control signal through a control signal outputting portion.

An integrated remote control system according to an exemplary embodiment of the present disclosure may easily add a control object thereto. In addition, a user can remotely control a plurality of control objects using one operation unit.

DETAILED DESCRIPTION

Figure 1:
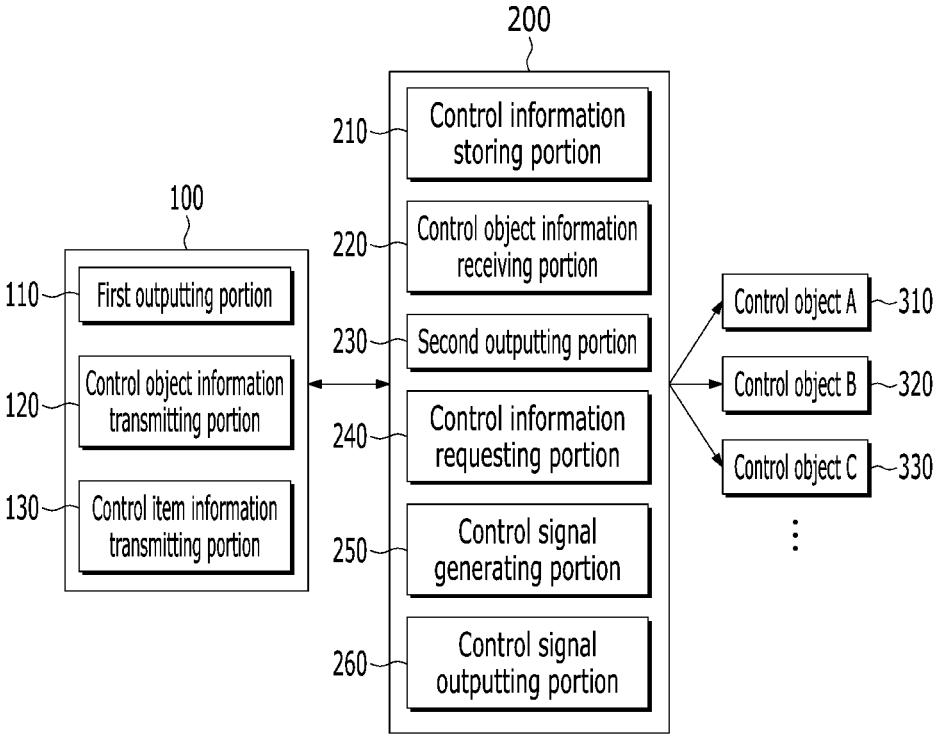
FIG. 1 is a block diagram of an integrated remote control system according to exemplary embodiments of the present disclosure.

The present disclosure will be described more fully hereinafter with reference to the accompanying drawings, in which exemplary embodiments of the disclosure are shown. As those skilled in the art would realize, the described embodiments may be modified in various different ways, all without departing from the spirit or scope of the present disclosure. To describe the present disclosure explicitly in the drawing, a part which is not related to the description will be omitted and the same reference numeral is used to the same or similar constituent elements in the entire specification. Also, in case of generally known prior art, the detailed description is omitted.

It will be further understood, unless it is explicitly described to the contrary, that the terms "comprises", "includes", "including" and/or "comprising," when used in this specification, specify the presence of stated features, integers, steps, operations, elements, and/or components, but do not preclude the presence or addition of one or more other features, integers, steps, operations, elements, components, and/or groups thereof. The terminology such as " . . . portion", "device", etc. in the specification means a unit which processes at least one function or one operation, and this can be embodied by a combination of hardware or software or hardware and software.

FIG. 1 is a block diagram of an integrated remote control system according to exemplary embodiments of the present disclosure.

As shown in FIG. 1, an integrated remote control system according to exemplary embodiments of the present disclosure includes a user operation device 100 and a gateway 200 connected with each other through a wireless communication network, receives a control object and a control item from a user through the user operation device 100, and generates and outputs a control signal corresponding to the control object and the control item through the gateway 200. At this time, the gateway 200 is connected with the control objects 310, 320, 330 etc. through a wireless communication network. For example, the control objects 310, 320, 330 etc. may include set-top boxes, home cinemas, air conditioners, TVs, DVDs, IPTVs, cameras, cleaners, fans, washing machine, drying machine, boilers, audios, and lighting equipment etc.

In FIG. 1, the user operation device 100, the gateway 200 and the control object (310, 320, 330 etc.) are positioned within a predetermined range, and transmit and receive data through a short-range wireless communication network such as bluetooth, IrDA, Zigbee, WiFi, etc.

The user operation device 100 includes a first outputting portion 110, a control object information transmitting portion 120 and a control item information transmitting portion 130.

The first outputting portion 110 outputs a control object list and a control item list based on at least one function device that can be physically coupled to, or decoupled from, the user operation device 100. In detail, the user operation device 100 receives the control object list and the control item list corresponding thereto from the at least one function device, and outputs the received control object list and the received control item list. At this time, the first outputting portion 110 outputs the control object list corresponding to the at least one function device, or outputs the control item list corresponding to the function device selected by the user.

The control object information transmitting portion 120 transmits a control object information corresponding to the function device selected by the user among the at least one function device physically coupled to the user operation device 100 to the gateway 200. Here, the control object information is identification information of the control object and includes, for example, a model name, a manufacturer and a type of an electronic device.

The control item information transmitting portion 130 transmits the control item information selected by the user among the control item list corresponding to the control object information transmitted through the control object information transmitting portion 120 to the gateway 200. In detail, the control item information transmitting portion 130 transmits the control item information about power, channel, temperature, brightness, volume, wind speed, mode switch, play, stop and/or other parameters of the control object to the gateway 200.

The gateway 200 includes a control information storing portion 210, a control object information receiving portion 220, a second outputting portion 230, a control information requesting portion 240, a control signal generating portion 250 and a control signal outputting portion 260.

The control information storing portion 210 stores information on the control objects 310, 320, 330 etc. In detail, the control information storing portion 210 can store a model name of the control object, the control item and a control code. At this time, the control code may be changed according to a manufacturer and a type of the control object.

The control object information receiving portion 220 receives the control object information transmitted from the user operation device 100, and transmits a response signal to the user operation device 100 when the control item and the control code corresponding to the received control object information exist in the control information storing portion 210.

The second outputting portion 230 searches the control items corresponding to the control object information in the control information storing portion 210 and outputs the searched control items in a voice message type.

The control information requesting portion 240, if the control item and the control code corresponding to the control object information received by the control object information receiving portion 220 do not exist in the control information storing portion 210, requests the corresponding control item and the corresponding control code to a server of the manufacturer through a wireless communication network, and stores the corresponding control item and the corresponding control code in the control information storing portion 210 when the corresponding control item and the corresponding control code are received from the server of the manufacturer. If the corresponding control item and the corresponding control code are not received from the server of the manufacturer, the control information requesting portion 240 outputs a warning through the second outputting portion 230.

The control signal generating portion 250 receives the control item information transmitted from the user operation device 100 and generates a control signal including the received control item information based on the control code stored in the control information storing portion 210.

The control signal outputting portion 260 outputs the control signal generated by the control signal generating portion 250. According to exemplary embodiments of the present disclosure, the control object receiving the control signal output from the control signal outputting portion 260 performs a function corresponding to the control item included in the control signal.

Figure 2:
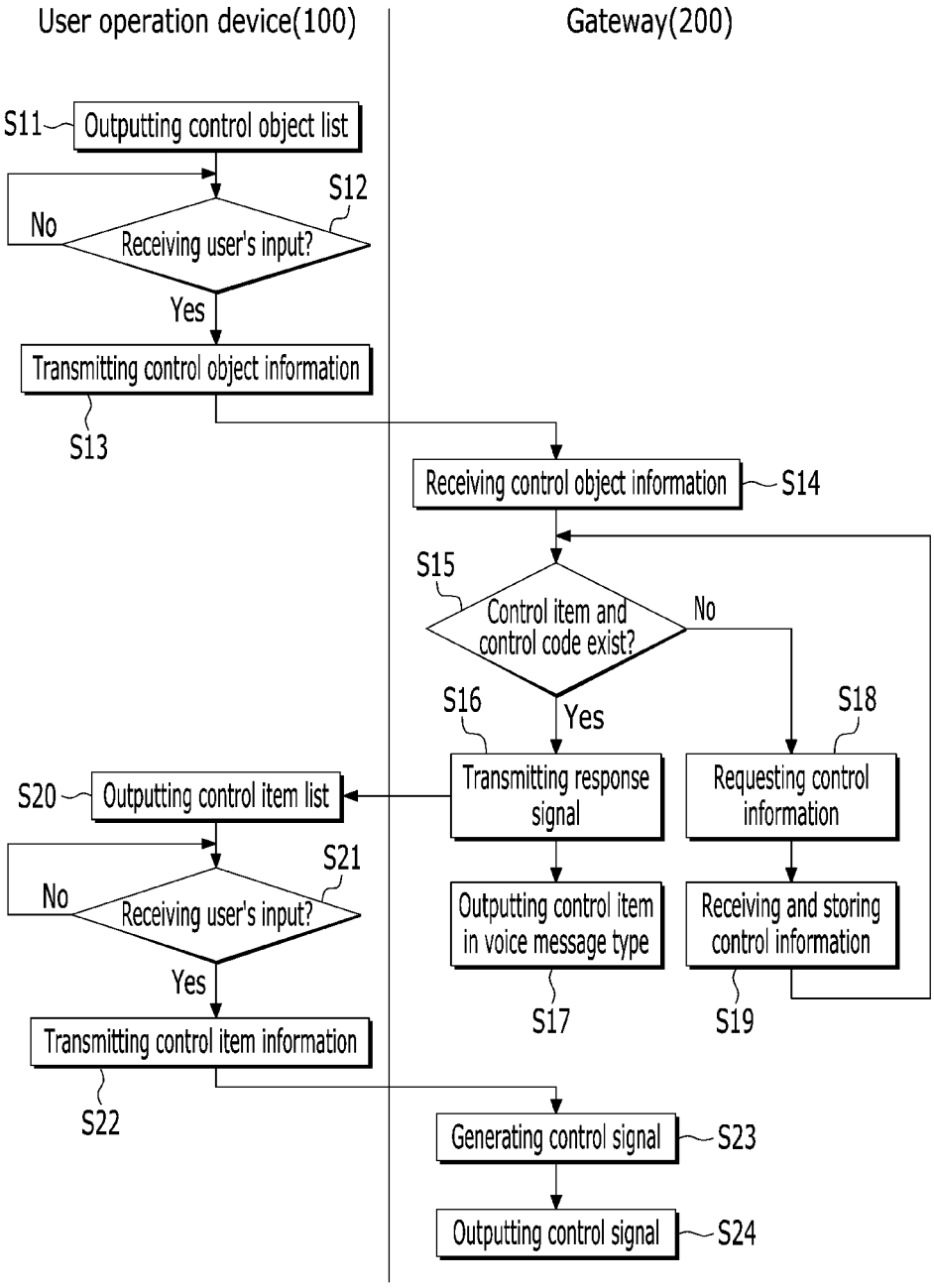
FIG. 2 is a flowchart of a remote control method using the integrated remote control system illustrated in FIG. 1.

FIG. 2 is a flowchart of a remote control method using the integrated remote control system of FIG. 1.

The user operation device 100 receives the control object list from the at least one function device physically coupled to the user operation device 100 and outputs the received control object list through the first outputting portion 110 at step S11.

If the user selects a specific function device at step S12, the control object information of the selected function device is transmitted to the gateway 200 through the control object information transmitting portion 120 at step S13.

Figure 3:
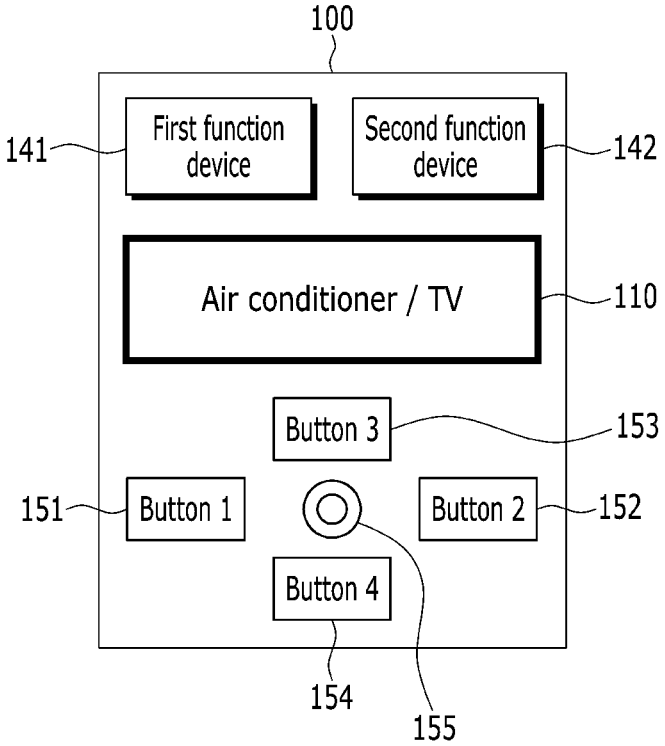
FIG. 3 illustrates an example of outputting a control object list using a user operation device according to exemplary embodiments of the present disclosure.

FIG. 3 illustrates an example of outputting a control object list using a user operation device according to exemplary embodiments of the present disclosure.

As shown in FIG. 3, the user operation device 100 includes a first function device 141 and a second function device 142 that can be physically coupled to, or decoupled from, the user operation device 100. In addition, the user operation device 100 includes button keys 151, 152, 153, 154 and 155 for controlling functions of control objects corresponding to the first and second function devices 141 and 142.

As shown in FIG. 3, first outputting portion 110 outputs the control object list (air conditioner, TV) received from the first function device 141 and the second function device 142.

Referring to FIG. 2, at step S14 the gateway 200 receives the control object information transmitted through the control object information receiving portion 220 at step S13, and searches that the control item and the control code corresponding to the control object information received at step S14 exist in the control information storing portion 210 at step S15. If the control item and the control code corresponding to the control object information exist in the control information storing portion 210, the response signal is transmitted to the user operation device 100 at step S16.

After that, the control item corresponding to the control object information received at step S14 is output through the second outputting portion 230 in the voice message type at step S17.

If it is determined at step S15 that the control item and the control code corresponding to the control object information received at the step S14 do not exist in the control information storing portion 210, the control information including the control item and the control code is requested to the server through control information requesting portion 240 at step S18. After that, the control information in response to the request at the step S18 is received from the server and is stored in the control information storing portion 210 at step S19.

If the user operation device 100 receives the response signal transmitted at the step S16, the user operation device 100 outputs the control item list corresponding to the function device selected at step S12 through the first outputting portion 110 at step S20. At this time, the control item list includes functions of the button keys of the user operation device 100 corresponding to the control object.

Figure 4:
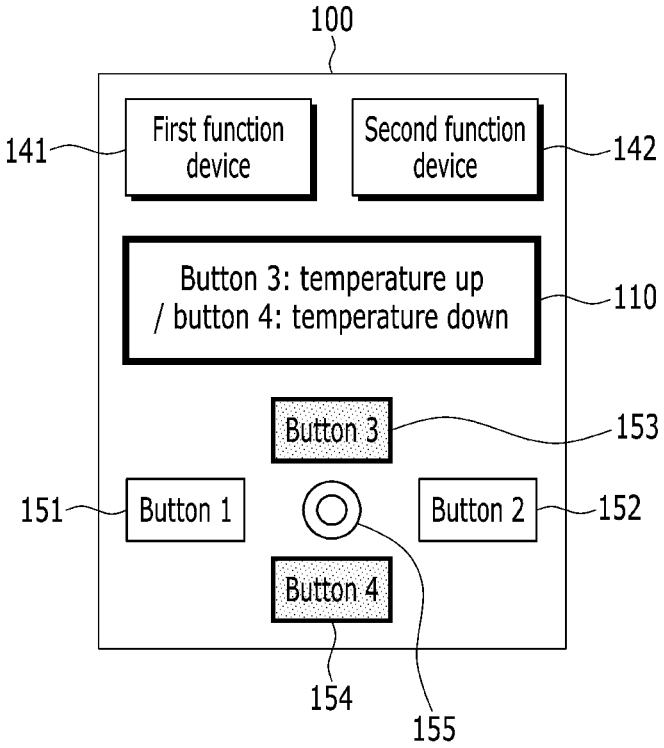
FIG. 4 illustrates an example of outputting a control item list using a user operation device according to exemplary embodiments of the present disclosure.
Figure 5:
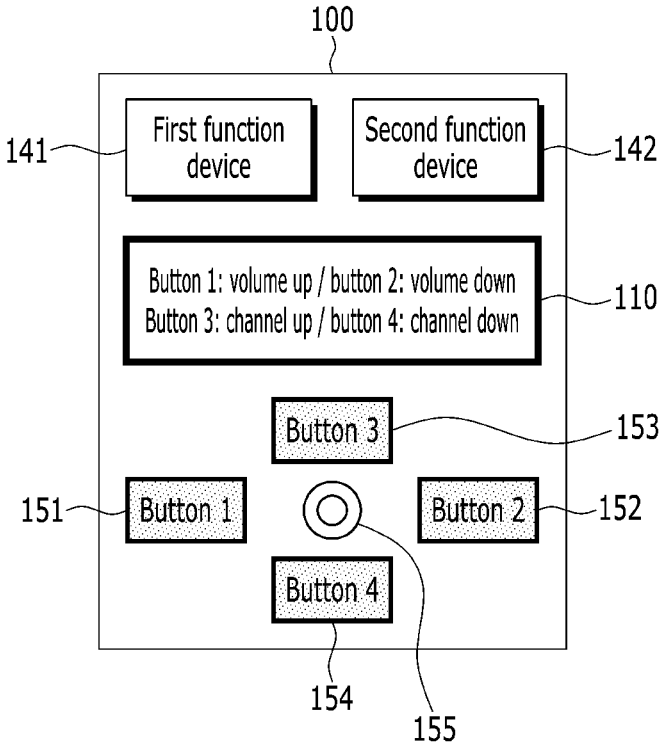
FIG. 5 illustrates an example of outputting a control item list using a user operation device according to exemplary embodiments of the present disclosure.

FIG. 4 and FIG. 5 illustrate examples of outputting a control item list using a user operation device according to exemplary embodiments of the present disclosure.

FIG. 4 illustrates the control item list output when the user selects the first function device corresponding to the air conditioner in the control object list illustrated in FIG. 3. As shown in FIG. 4, button keys (button 3 and button 4) that can control temperature of the air conditioner and functions of the corresponding button keys (temperature up and temperature down) are output through the first outputting portion 110. At this time, operable button keys (button 3 and button 4) 153 and 154 may be highlighted by lighting means such as a light-emitting diode (LED) to indicate the activated button keys (operable button keys) to the user.

FIG. 4 illustrates the control item list output when the user selects the second function device corresponding to the TV in the control object list illustrated in FIG. 3. As shown in FIG. 5, button keys (button 1 to button 4) that control volume and channel of the TV and functions of the corresponding button keys (volume up, volume down, channel up, and channel down) are output through the first outputting portion 110.

Referring to FIG. 2 again, if a specific button key is selected by the user in the user operation device illustrated in FIG. 4 to FIG. 5 at step S21, the selected button key information (control item information) is transmitted to the gateway 200 through the control item information transmitting portion 130 at step S22.

After that, the gateway 200 receives the button key information (control item information) transmitted at step S22 through the control signal generating portion 250, and generates the control signal based on the control code corresponding to the received button key information at step S23.

At step S24, the control signal generated at the step S23 is output through the control signal outputting portion 260.

It is disclosed in this specification, but is not limited, that the first function device and the second function device are coupled to the user operation device. That is, more or fewer function devices can be coupled to the user operation device.

As shown in FIG. 3, when the function devices corresponding to the air conditioner and the TV are coupled to the user operation device 100, the user can control functions of the air conditioner and the TV through the user operation device 100 and the gateway 200 as shown in the below Table 1.

TABLE 1

| | user operation device | | gateway | | |
|---|---|---|---|---|---|
| Function device | Activated button | User's selection | Received information | Control signal output | control object |
| Air conditioner | button3, button4 | button 3 | Air conditioner/ button3 | control object 1/ temperature up | temperature up |
| TV | button 1 to button 5 | button 3 | TV/ button3 | control object 2/ volume up | volume up |

According to exemplary embodiments of the present disclosure, the control objects can be added by additionally coupling the function devices to the user operation device, and convenience of the user can be improved by disposing function devices considering types and frequency of use of the electronic devices and hands and fingers that the user often uses.

The remote control method according to exemplary embodiments of the present disclosure can be initially installed in the user operation device and the gateway, or can be realized as a program and be recorded in a computer readable recording medium. Here, a computer may be a desktop, a laptop, a smart phone, a tablet PC, a personal digital assistant (PDA), or a mobile communication device. In addition, a recording medium may be a ROM, a RAM, a CD-ROM, a magnetic tape, a floppy disk, or an optical recording device.

A program embodying the remote control method according to exemplary embodiments of the present disclosure includes program instructions for storing the control item and the control code of the control object corresponding to the function device coupled to the user operation device, program instructions for receiving the control object information transmitted from the user operation device and transmitting the response signal, program instructions for receiving the control item information from the user operation device in response to the response signal, program instructions for generating the control signal including the received control item information based on the control code, and program instructions for outputting the generated control signal.

While this disclosure has been described in connection with what is presently considered to be practical exemplary embodiments, it is to be understood that the disclosure is not limited to the disclosed embodiments, but, on the contrary, is intended to cover various modifications and equivalent arrangements included within the spirit and scope of the appended claims.

What is claimed is:

1. An integrated remote control system, comprising:

a user operation device for receiving a control object list and a control item list from at least one function device, physically and detachably coupled to the user operation device, and for displaying the received control object list or the received control item list for a user to select therefrom at least one control object or at least one control item, wherein the at least one control object respectively corresponds to the at least one function device physically and detachably coupled to the user operation device, and the at least one control item respectively corresponds to the at least one function device physically and detachably coupled to the user operation device; and a gateway connected to the user operation device through a wireless communication network, the gateway generating and outputting a control signal corresponding to the at least one control object or the at least one control item selected by the user.

2. The integrated remote control system of claim 1, wherein the user operation device comprises:

a first outputting portion for displaying the control object list or the control item list received from the at least one function device physically and detachably coupled to the user operation device;

a control object information transmitting portion for transmitting control object information about the at least one control object selected by the user to the gateway; and a control item information transmitting portion for transmitting control item information about the at least one control item selected by the user.

3. The integrated remote control system of claim 1, wherein the user operation device includes a plurality of button keys corresponding to the control item list, and a button key corresponding to the at least one control item selected by the user among the plurality of button keys is highlighted.

4. The integrated remote control system of claim 1, wherein the gateway comprises:

a control information storing portion for storing at least one control item and at least one control code of at least one control object corresponding to each of the at least one function device;

a control object information receiving portion for receiving the control object information selected by the user;

a control signal generating portion for receiving the control item information selected by the user and generating a control signal including the received control item information based on the at least one control code stored in the control information storing portion; and a control signal outputting portion for outputting the generated control signal.

5. The integrated remote control system of claim 4, wherein the control object information receiving portion transmits a response signal to the user operation device when the at least one control item and the at least one control code corresponding to the received control object information exist in the control information storing portion, and the user operation device outputs the control item list corresponding to the control object information when the user operation device receives the response signal.

6. The integrated remote control system of claim 4, further comprising a control information requesting portion for requesting the at least one control item and the at least one control code to a server when the at least one control item and the at least one control code corresponding to the control object information do not exist in the control information storing portion.

7. A non-transitory computer readable recording medium which records program instructions for executing a remote control method through an integrated remote control system, the non-transitory computer readable recording medium comprising the program instructions which cause a processor to perform the steps of:

storing at least one control item and at least one control code of at least one control object corresponding to each function device capable of being detachably coupled to a user operation device in a control information storing portion;

receiving a control object information corresponding to each function device physically and detachably coupled to the user operation device and selected by a user from the user operation device through a control object information receiving portion and transmitting a response signal to the user operation device when a control item and a control code corresponding to the received control object information exist in the control information storing portion;

receiving a control item information selected by the user from the user operation device through a control item information receiving portion in response to the response signal;

generating a control signal including the received control item information based on the at least one control code stored in the control information storing portion through a control signal generating portion;

outputting the generated control signal through a control signal outputting portion; and searching for the control item corresponding to the received control object information among the at least one control item stored in the control information storing portion and outputting the searched control item in a voice message type.

8. The non-transitory computer readable recording medium of claim 7, further comprising program instructions for requesting the control item and the control code corresponding to the received control object information to a server through a control information requesting portion when the control item and the control code corresponding to the received control object information is not searched from the at least one control item and the at least one control code stored in the control information storing portion.

* * * * *